US005360063A

United States Patent [19]

Henderson, Jr.

[11] Patent Number: 5,360,063

[45] Date of Patent: Nov. 1, 1994

[54] WEAR BUSHING WITH LOCKING COLLET

[75] Inventor: Herman O. Henderson, Jr., Houston, Tex.

[73] Assignee: ABB Vetco Gray Inc., Houston, Tex.

[21] Appl. No.: 962,374

[22] Filed: Oct. 15, 1992

[51] Int. Cl.[5] ..... E21B 33/00

[52] U.S. Cl. ..... 166/208; 166/348

[58] Field of Search ..... 166/208, 82, 84, 85, 166/368, 348, 382

[56] References Cited

U.S. PATENT DOCUMENTS 4,978,147 12/1990 Henderson, Jr. et al. ..... 166/368 X
5,025,864 6/1991 Nobileau ..... 166/348
5,076,356 12/1991 Reimert ..... 166/208 X
5,080,173 1/1992 Brammer ..... 166/208 X

*Primary Examiner*—Thuy M. Bui
*Attorney, Agent, or Firm*—James E. Bradley

[57] ABSTRACT

A wear bushing assembly for a subsea well to protect a casing hanger during drilling latches by use of a collet. The wear bushing includes a tubular member which lands on the upper end of the casing hanger. A metal collet secures to the wear bushing. The collet has slots in it so as to allow it to radially deflect. The collet has an external shoulder which snaps into and latches in a profile formed in the casing hanger. The collet may serve as a protective portion of the wear bushing.

17 Claims, 3 Drawing Sheets

WEAR BUSHING WITH LOCKING COLLET

BACKGROUND OF THE INVENTION

1. Field of the Invention

This invention relates to a device for locking together inner and outer members of an oil or gas well, and particularly to a locking device for locking a drilling wear bushing within a casing hanger.

2. Description of the Prior Art

There are instances in which an inner tubular member must be releasably locked into an outer tubular member within a well. For example, in a subsea well of the type concerned herein, a subsea wellhead housing will be located on the sea floor. A casing hanger will land in the subsea housing. The casing hanger locates at the top of a string of casing that extends into the well. An annular seal will seal between the casing hanger and the wellhead housing.

If the well is to be drilled deeper, the drilling rig at the surface will run drill pipe down through the casing hanger and through the casing for drilling. It is important to avoid damaging the bore of the casing hanger and also the casing where it connects to the casing hanger. The operator will lower a wear bushing into the bore of the casing hanger to prevent damage from the rotating drill pipe.

The wear bushing needs to be retained in the bore of the casing hanger. Without some type of retention mechanism, the wear bushing might be dislodged by circulation of heavy solids or by tripping of the drill pipe through the wellhead during normal drilling operations. If the wear bushing is dislodged, it could reposition itself in the blowout preventer stack and cause damage to or failure of the blowout preventer to shut in the well during a pressure "kick". This could subject the rig to a blowout, causing serious damage.

There are various mechanisms for retaining wear bushings, including shear pins, lock rings, or J-pins made of steel or other metallic alloys. While workable, users have experienced failure in activating or releasing these devices. It is difficult to recover the wear bushing if the locking mechanism fails to release.

U.S. Pat. No. 4,978,147 shows an elastomeric ring which will snap into the casing hanger profile for installation of the wear bushing and shear out to remove the wear bushing. While workable, in some cases, particularly with smaller wellhead housings, insufficient wall thickness is available for placement of the groove in the wear bushing that is necessary for the elastomeric ring.

SUMMARY OF THE INVENTION

In this invention, the wear bushing has a tubular member which lands on an upper end of the casing hanger. A metal collet secures to the tubular member. The metal collet has a plurality of axial slots so as to allow radial deflection of the collet. The collet has an external upward facing shoulder and an undeflected outer diameter at that shoulder which is greater than the inner diameter of the casing hanger at the casing hanger profile. As the wear bushing lands, the collet will deflect inward and engage the profile. A greater upward force is necessary to release the collet from the profile than the downward force.

DETAILED DESCRIPTION OF THE INVENTION

Figure 1:
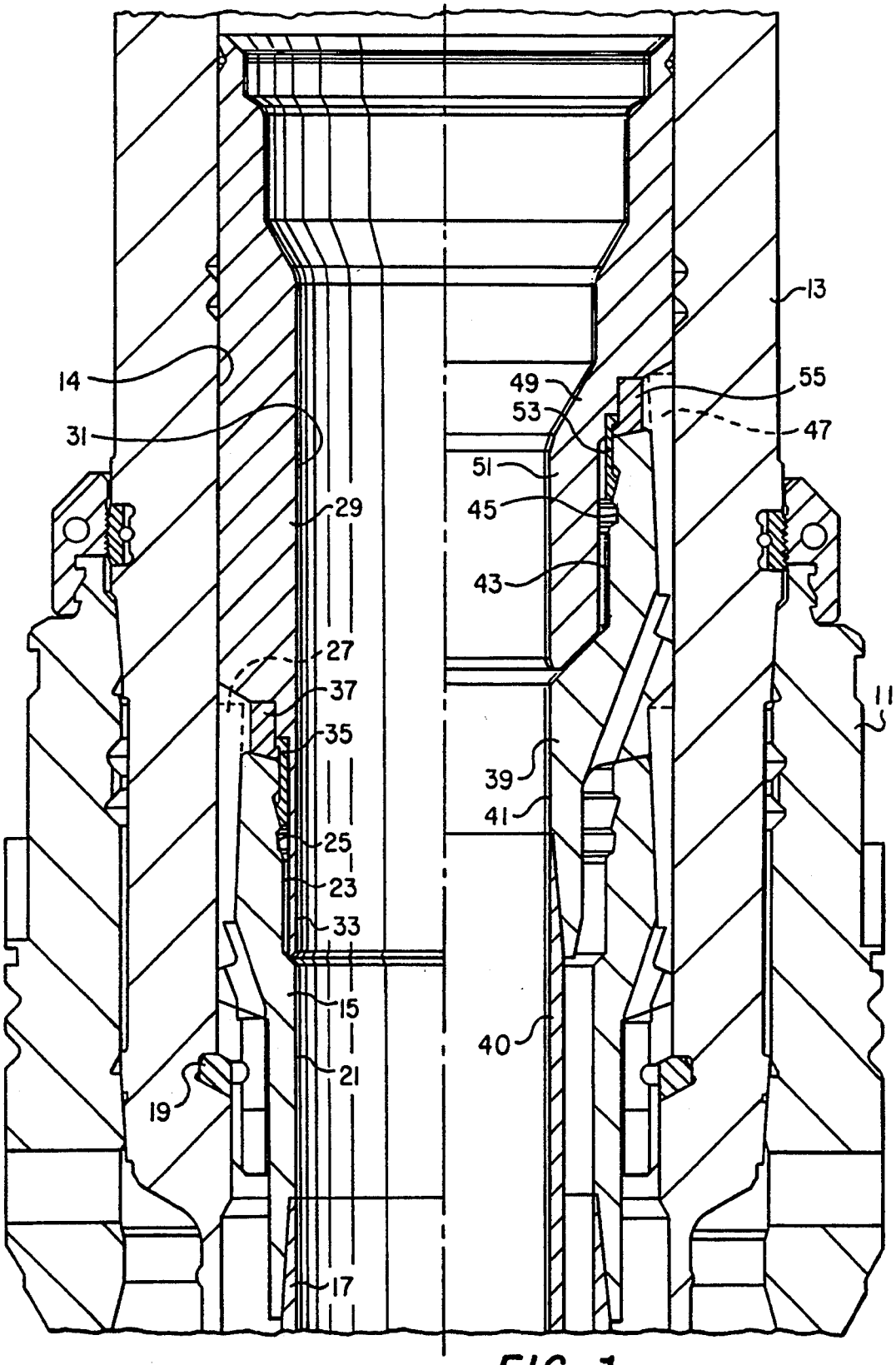
FIG. 1 is a half sectional view of a subsea wellhead, showing on the left side a wear bushing installed for a lower casing hanger, and on the right side, a wear bushing installed for an upper casing hanger.

FIG. 1 shows a subsea wellhead system including an outer wellhead housing 11 which secures to outer conductor pipe (not shown) that extends to a first depth in the well. An inner wellhead housing 13 lands in outer wellhead housing 11. Inner wellhead housing 13 secures to conductor pipe (not shown) that extends to a second depth in the well. Inner wellhead housing 13 has a bore 14 which has a longitudinal axis.

A first or lower casing hanger 15 lands in inner wellhead housing 13. Lower casing hanger 15 secures to a first or outer string of casing 17 which extends to a third depth in the well. Casing hanger 15 lands on a shoulder 19 located in bore 14. Casing hanger 15 has a lower bore portion 21 that is of lesser diameter than the upper bore portion 23. The lower bore portion 21 has an inner diameter that is the same as the inner diameter of the casing 17. Upper bore portion 23 has an internal annular recess or profile 25. A casing hanger seal 27 of conventional design locates between the exterior of casing hanger 17 and axial bore 14.

A wear bushing 29 will be installed on casing hanger 15 to protect upper bore portion 23 while drilling the well through casing 17 to a greater depth. Wear bushing 29 has an axial bore 31 that has an inner diameter that equals the inner diameter of lower bore portion 21 and casing 17. Wear bushing 29 lands on the upper end of casing hanger 15. A lower portion 33 extends down within upper bore portion 23. Lower portion 33 extends past and protects profile 25.

An annular collet 35 is used to latch wear bushing 29 in place. Collet 35 latches into profile 25, as will be explained in more detail subsequently. Collet 35 is secured by securing means to wear bushing 29. The lower portion 33 of wear bushing 29 extends through the inner diameter of collet 35 and past the lower end of collet 35. The securing means shown in FIG. 1 comprises a retaining ring 37 that secures to and forms the lower end of wear bushing 29.

Wear bushing 29 is removed after the well has been drilled to the selected depth through casing 17. Then, an upper casing hanger 39 will be installed on lower casing hanger 15. Upper casing hanger 39 in the embodiment shown supports a string of casing 40. Upper casing hanger 39 has a lower bore portion 41 that has an inner diameter that equals the inner diameter of casing 40. Upper casing hanger 39 has an upper bore portion 43 that is of significantly greater inner diameter. A recess or profile 45 is located in upper bore portion 43. A conventional casing hanger seal 47 seals between the exterior of upper casing hanger 39 and inner wellhead housing 13.

A wear bushing 49 lands on upper casing hanger 39 to protect profile 45 during drilling and other operations through casing 40. Wear bushing 49 has a lower portion 51 that extends the full length of the casing hanger upper bore portion 43. The inner diameter of lower portion 51 equals the inner diameter of lower bore portion 41 and casing 40.

A collet 53 releasably latches wear bushing 49 to casing hanger 39. The lower portion 51 of wear bushing 49 extends through the inner diameter of collet 53 and downward past the lower end of collet 53. Collet 53 has the same structure and is the same size as collet 35. Collet 53 is secured to wear bushing 49 by securing means which includes a retaining ring 55. In the embodiment shown in FIG. 1, inner wellhead housing bore 14 has a diameter of 18 ¾ inch, casing hanger lower bore portion 21 and outer casing 17 have an inner diameter of 13 ⅜ inch, and casing hanger lower bore portion 41 and casing 40 have an inner diameter of 9⅝ inch.

Figure 2:
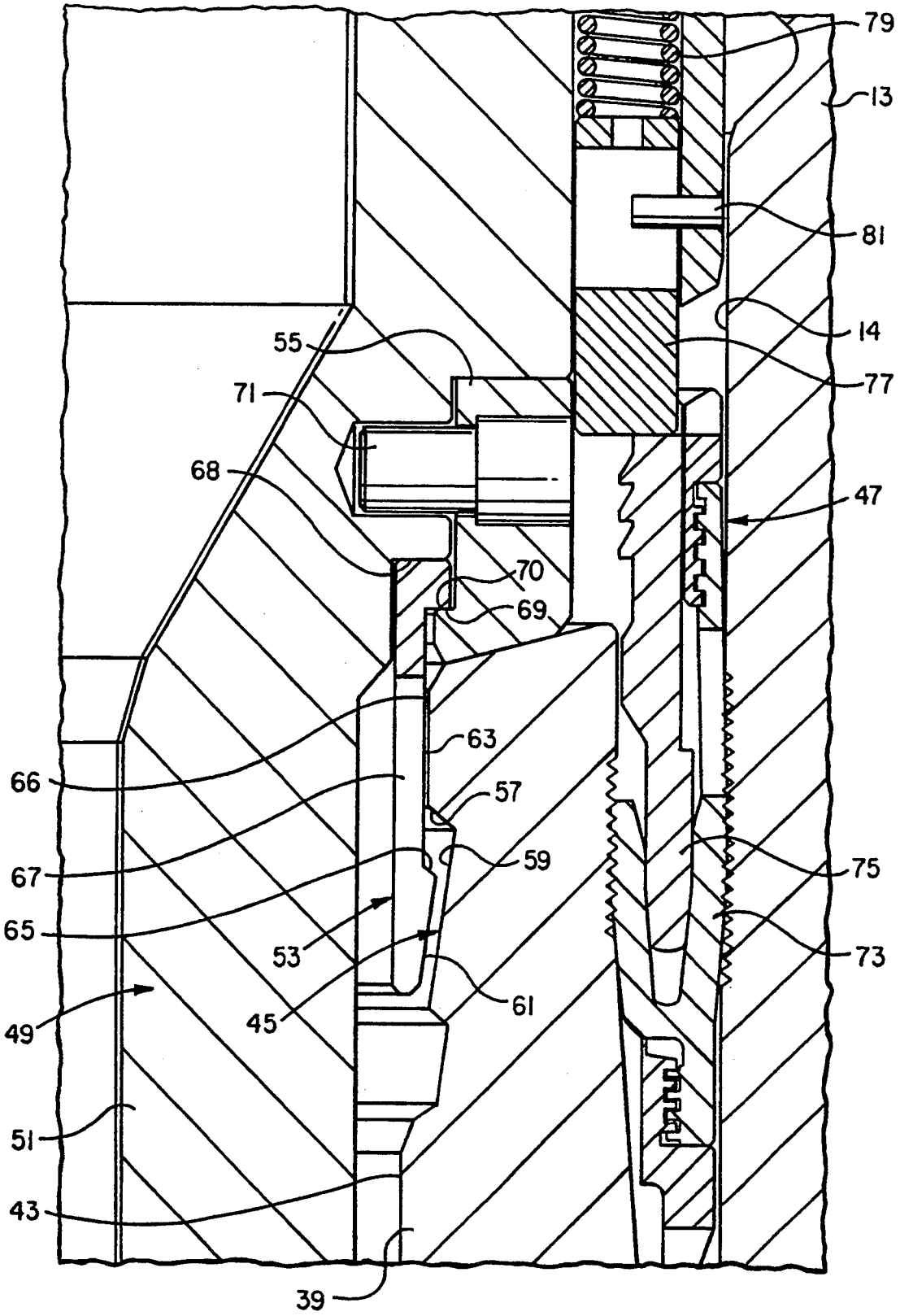
FIG. 2 is an enlarged quarter sectional view of a portion of the wear bushing for the upper casing hanger of FIG. 1.

FIG. 2 shows more details of the structure and securing means of collet 53. As collet 35 is the same in structure, it is not shown in an enlarged drawing. Referring to FIG. 2, profile 45 includes a downward facing conical shoulder 57 that tapers at an angle of about 62.5 degrees relative to the longitudinal axis of casing hanger 39, or 37.5 degrees relative to horizontal. Profile 45 also has an upper recess 59 that extends downward from downward facing shoulder 57 at an angle of about seven degrees relative to the longitudinal axis of casing hanger 39.

Collet 53 is a generally cylindrical metal ring. Collet 53 has a lower exterior portion 61 that is conical, with a diverging taper in an upward direction. The degree of taper is approximately seven degrees relative to the longitudinal axis of casing hanger 39. The lower exterior portion 61 joins an upper cylindrical portion 63. An upward facing conical shoulder 65 locates at this junction. Upward facing shoulder 65 has an angle of taper approximately equal to downward facing shoulder 57, which is approximately 62.5 degrees relative to the longitudinal axis of casing hanger 39. The outer diameter of shoulder 65 when collet 53 is undeflected is greater than the inner diameter of upper bore portion 66 immediately above profile 45. The outer diameter of the upper cylindrical portion 63 is slightly less than the inner diameter of the upper bore portion 66. The undeflected outer diameter of the lower end of the lower exterior portion 61 is less than the undeflected outer diameter of the shoulder 65.

A plurality of slots 67 extend through the side wall of collet 53 parallel to the longitudinal axis of wear bushing 49. Slots 67 are evenly spaced circumferentially around collet 53. Slots 67 extend completely to the lower end of collet 53 and terminate in the upper cylindrical portion 63 a selected distance below the upper end of collet 53. Slots 67 provide resiliency to collet 53, allowing a lower portion to deflect radially inward to allow shoulder 65 to slide past upper bore portion 66. The seven degree taper of the lower conical portion 61 allows collet 53 to slide downward past upper bore portion 66 with a force that is much less than the force required to pull collet 53 upward from profile 45. The greater retrieval force required is a result of the difference in inclination between the conical shoulder 65 and the conical surface 61.

Collet 53 has an upper end that bears against a downward facing shoulder 68 formed on wear bushing 49. Collet 53 has an external lip 69. An upward facing shoulder 70 on the inner diameter of retaining ring 55 will engage shoulder 68 to retain collet 53. Retaining ring 55 is secured by fasteners 71, which may be pins or screws. The fasteners 71 extend from the outer diameter of retaining ring 55 inward. Access to fasteners 71 is from the exterior of retaining ring 55. Retaining ring 55 serves as a downward facing shoulder on wear bushing 49 to contact the upper end of casing hanger 39.

FIG. 2 shows more details of casing hanger seal 47, which is conventional. Casing hanger seal 47 includes a U-shaped member 73 which is deformed outward by downward movement of an energizing ring 75. Wear bushing 49 includes a conventional antirotation means to prevent its rotation with drill pipe. The antirotation means includes an antirotation key 77 mounted vertically in wear bushing 49. Antirotation key 77 engages a slot formed in the upper end of energizing ring 75. Antirotation key 77 is urged downward by a coil spring 79. A pin 81 retains antirotation key 77.

In the operation of the embodiment shown in FIGS. 1 and 2, after casing hanger 15 lands and casing 17 is cemented in place, the operator will install casing hanger seal 27. The operator will then lower wear bushing 29 onto casing hanger 15. Straight downward movement of wear bushing 29 causes collet 35 to slide into the upper bore portion 23 and snap into profile 25.

The operator will then lower a string of drill pipe and continue drilling the well. After this portion of the drilling has been completed, the operator will lower a retrieving tool (not shown) to retrieve wear bushing 29. When retrieving, collet 35 will snap out of profile 25 with a sufficient upward pull. Then, the operator will run casing 40 on casing hanger 39. After casing 40 has been cemented in place and casing hanger seal 47 installed, the operator will lower wear bushing 49.

Referring also to FIG. 2, initially, the conical exterior section 61 will contact the casing hanger upper bore portion 66. This causes a lower portion of collet 53 to deflect radially inward. Continued straight downward movement causes the shoulder 65 to slide past upper bore portion 66 and snap into profile 45. Retaining ring 55 will come into contact with the upper end of casing hanger 39. Once landed, a substantial axial clearance will exist between shoulder 65 and shoulder 57. Antirotation key 77 will engage a slot in energizing ring 75 to prevent rotation.

After drilling operations through casing 40 have been completed, and the operator wishes to retrieve wear bushing 49, he will lower a retrieving tool which will spear wear bushing 49 or engage J slots or the like (not shown) in the upper end of wear bushing 49. The operator will pull upward. Shoulder 65 will contact shoulder 57. Because of the substantial taper of shoulder 57 relative to the axis, a much larger force is required to pull collet 53 past shoulder 57 than the insertion force. Continued upward pull will cause collet 53 to release from profile 45, allowing wear bushing 49 to be retrieved.

Figure 3:
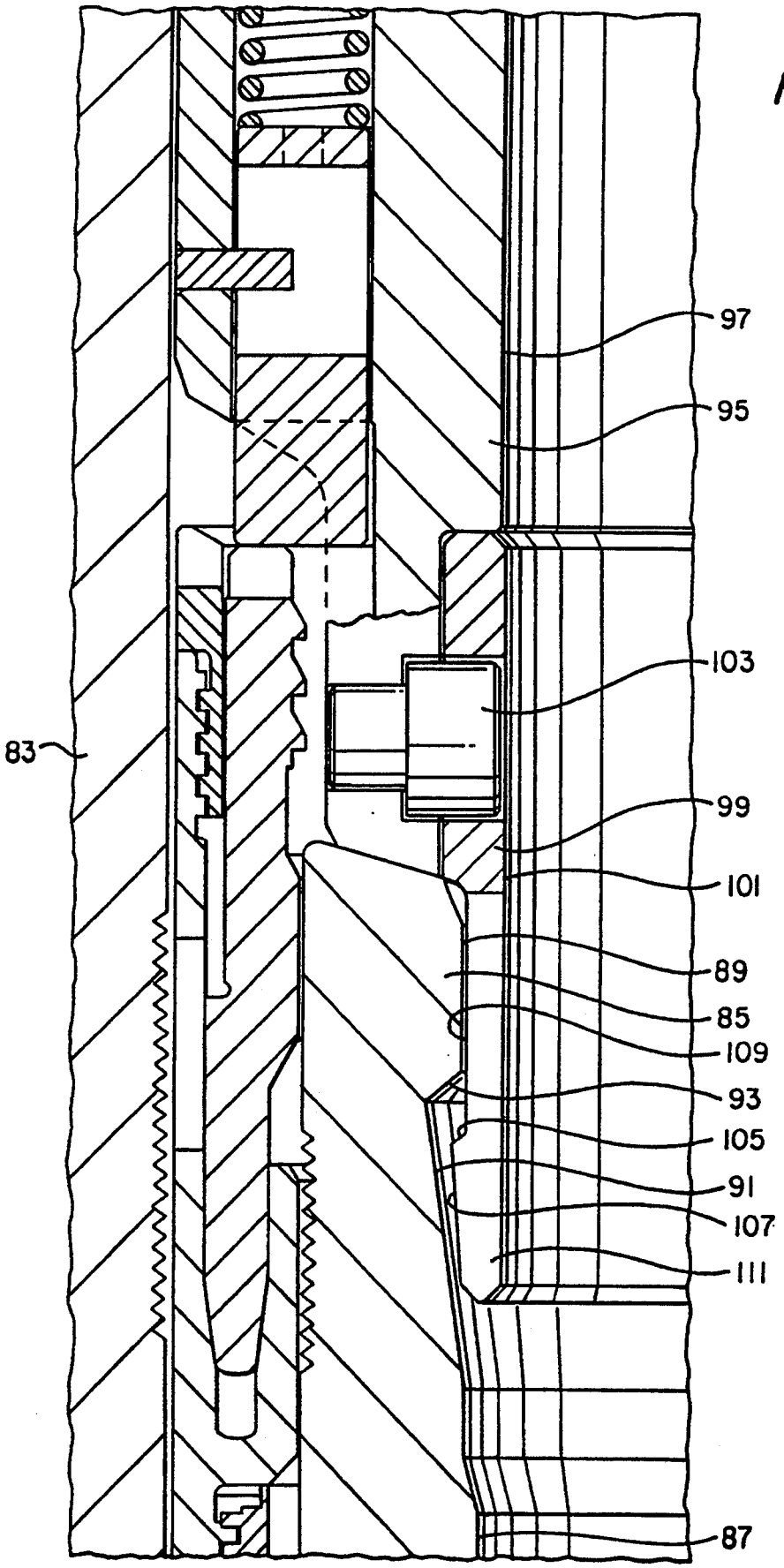
FIG. 3 is an alternate embodiment of a portion of a wear bushing for installation in a larger bore casing hanger than the one shown in FIG. 1.

FIG. 3 shows an alternate embodiment, particularly for use with an inner wellhead housing 83 that has an inner diameter smaller than the inner diameter of the 18—¾ inch inner wellhead housing 13 (FIG. 1). The inner diameter of wellhead housing 83 may be 16¾ inch, yet the casing strings 17 and 40 may still be 13 ⅜ and 9 ⅝ inch, respectively. As a result, casing hanger 85 will have a lower bore portion 87 and an upper bore portion 89 that differ in inner diameters, however the difference will be much less than the difference between the bore portions 21, 23 of casing hanger 15 of FIG. 1. A profile 91 will exist in the upper bore portion 89. Profile 91 has a downward facing shoulder 93 that preferably is conical with a degree of taper of 62.5 degrees relative to the longitudinal axis.

Wear bushing 95 has a bore 97 that has the same inner diameter as lower bore portion 87. A collet 99 extends downward and forms the lowermost portion of wear bushing 95. Wear bushing 95 will not have a lower portion that extends past profile 91 and through collet 99 as does the lower portion 33 of wear bushing 29 in FIG. 1. Rather collet 99 will serve as protection for the profile 91. Collet 99 has a bore 101 that has the same inner diameter as bore 97 of wear bushing 95 and the same as lower bore portion 87 of casing hanger 85. This is the same inner diameter as the casing that will be supported by casing hanger 85. There will be no structure located radially inward of collet 99.

The securing means for securing collet 99 in the embodiment shown comprises fasteners 103 that extend through holes in the upper portion of collet 99. Fasteners 103 extend from the inner side outward and comprise pins or screws. The head of each fastener 103 will be substantially flush with bore 101 of collet 99. Fasteners 103 engage holes formed in the lower end of wear bushing 95.

Collet 99 has an upward facing conical shoulder 105 and a lower exterior portion 107. The configurations of shoulder 105 and exterior portion 107 are the same as the configurations of shoulder 65 and exterior portion 61 of collet 53 of FIG. 2. The taper of exterior portion 107 is approximately seven degrees relative to the axis. The taper of shoulder 105 is approximately 62.5 degrees relative to the axis. This angle of taper is the same as the taper of the downward facing shoulder 93.

An upper cylindrical portion 109 extends upward from shoulder 105. A plurality of vertical slots 111 are spaced around collet 99 to allow it to flex radially inward during insertion. The outer diameter of shoulder 105 is greater than the inner diameter of upper bore portion 89 above shoulder 93. Slots 111 allow the lower exterior portion 107 to deflect inward during insertion and to deflect outward after pulling upward. Wear bushing 95 is installed in the same manner as wear bushing 29 of the embodiment of FIG. 1.

This invention has significant advantages. The metal collet forming a part of the wear bushing allows the bushing to be easily latched in place by a straight downward movement. The collet allows the wear bushing to be retrieved by an upward overpull. The collet allows a lower portion of the wear bushing to extend past for protecting the bore of the casing hanger in some embodiments. In the case where very little clearance exists, the collet itself can serve as a protective member for protecting the profile in the upper portion of the casing hanger.

While the invention has been shown in only two of its forms, it should be apparent to those skilled in the art that it is not so limited, but is susceptible to various changes without departing from the scope of the invention.

I claim:

1. In a well assembly of the type having a wellhead housing having a longitudinal axis, a casing hanger landed in the wellhead housing and supporting a string of casing extending into the well, an annular profile formed in an interior portion of the casing hanger, the profile having a downward facing shoulder, an improved means for reducing wear damage occurring when a string of drill pipe is rotated in the well, comprising in combination:

a wear bushing which lands on an upper end of the casing hanger;

a metal collet having a plurality of slots so as to allow radial deflection of the collet, the collet having an external upward facing shoulder and an undeflected outer diameter at the upward facing shoulder which is greater than an inner diameter of the casing hanger at the downward facing shoulder of the casing hanger; and securing means for carrying the collet on the wear bushing in a position such that downward movement of the wear bushing onto the casing hanger will cause the upward facing shoulder of the collet to slide past the downward facing shoulder of the casing hanger and deflect outward into the profile, preventing upward movement of the wear bushing unless a sufficient upward force is applied.

2. The well assembly according to claim 1 wherein the upward facing shoulder locates a selected distance below the downward facing shoulder of the casing hanger when the wear bushing lands on the casing hanger, defining an axial gap.

3. The well assembly according to claim 1 wherein the collet has a lower end and a lower exterior portion extending from the lower end upward to the upward facing shoulder, the lower exterior portion having a conical tapered exterior with the undeflected outer diameter at the upward facing shoulder being greater than an outer diameter at the lower end of the collet.

4. The well assembly according to claim 1 wherein the downward facing shoulder of the casing hanger is conical, and wherein the upward facing shoulder of the collet is conical and has a same angle of taper as the downward facing shoulder of the casing hanger.

5. The well assembly according to claim 1 wherein the collet extends downward from a lowermost portion of the wear bushing.

6. The well assembly according to claim 1 wherein the wear bushing has a lower portion that extends through an inner diameter of the collet and downward past a lower end of the collet.

7. The well assembly according to claim 1 wherein the securing means comprises at least one fastener extending through an upper end of the collet into a portion of the wear bushing.

8. The well assembly according to claim 1 wherein the securing means comprises:

a retaining ring having means for engaging an upper end of the collet; and means for securing the retaining ring to the wear bushing.

9. In a well assembly of the type having a wellhead housing having a longitudinal axis, a casing hanger landed in the wellhead housing and supporting a string of casing extending into the well, an annular profile formed in an interior portion of the casing hanger, the profile having a downward facing conical shoulder, an improved means for reducing wear damage occurring when a string of drill pipe is rotated in the well, comprising in combination:

a wear bushing which lands on an upper end of the casing hanger;

a metal collet having an upper end, a lower end, and a plurality of slots extending upward from the lower end a selected distance so as to allow radial deflection of a lower portion of the collet, the collet having a conical exterior portion extending upward from the lower end to an external upward facing shoulder which has an undeflected outer diameter that is greater than an inner diameter of the casing hanger at the downward facing shoulder of the casing hanger and greater than an outer diameter of the lower end of the collet; and securing means for securing the upper end of the collet to the wear bushing in a position such that downward movement of the collet into the casing hanger will cause the upward facing shoulder of the collet to slide past the downward facing shoulder of the casing hanger and deflect outward into the profile, preventing upward movement of the wear bushing unless a sufficient upward force is applied.

10. The well assembly according to claim 9 wherein the upward facing shoulder locates a selected distance below the downward facing shoulder of the casing hanger when the wear bushing lands on the casing hanger, defining an axial gap.

11. The well assembly according to claim 9 wherein the collet extends downward past a lowermost portion of the wear bushing.

12. The well assembly according to claim 9 wherein the wear bushing has a lower portion that extends through an inner diameter of the collet and downward past the lower end of the collet.

13. The well assembly according to claim 9 wherein the securing means comprises at least one fastener extending through an upper end of the collet into a portion of the wear bushing.

14. The well assembly according to claim 9 wherein the securing means comprises:

a retaining ring having means for engaging the upper end of the collet; and means for securing the retaining ring to the wear bushing.

15. In a well assembly of the type having a wellhead housing having a longitudinal axis, a casing hanger landed in the wellhead housing and supporting a string of casing extending into the well, an annular profile formed in an interior portion of the casing hanger, the profile having a downward facing conical shoulder, the casing hanger having a lower portion having an inner diameter that is the same as an inner diameter of the casing, an improved means for reducing wear damage occurring when a string of drill pipe is rotated in the well, comprising in combination:

a wear bushing having a longitudinal axis and having a lower end adapted to land on a upper end of the casing hanger;

a metal collet having an upper end, a lower end, and a plurality of slots extending upward from the lower end a selected distance so as to allow radial deflection of a lower portion of the collet, the collet having a conical exterior portion extending upward from the lower end to an external upward facing shoulder, which has an undeflected outer diameter that is greater than an inner diameter of the casing hanger above the downward facing shoulder of the casing hanger and greater than an outer diameter of the lower end of the collet, the collet having an inner diameter that is substantially the same as the inner diameter of the lower portion of the casing hanger;

securing means for securing the upper end of the collet to the wear bushing at the lower end of and extending downward from the wear bushing such that downward movement of the wear bushing onto the casing hanger at a sufficient downward force will cause the upward facing shoulder of the collet to slide past the downward facing shoulder of the casing hanger and deflect outward into the profile, preventing upward movement of the wear bushing unless a sufficient upward force is applied; and the upward facing shoulder having an angle of taper relative to the axis that is greater than an angle of taper of the conical exterior portion relative to the axis, so that the upward force to retrieve the wear bushing from the casing hanger is substantially greater than the downward force to insert the collet into the casing hanger.

16. The well assembly according to claim 15 wherein the upward facing shoulder locates a selected distance below the downward facing shoulder of the casing hanger when the wear bushing lands on the casing hanger, defining an axial gap.

17. The well assembly according to claim 15 wherein the collet has a cylindrical portion that extends upward from the upward facing shoulder.

* * * * *